US006231445B1

(12) United States Patent
Acres

(10) Patent No.: US 6,231,445 B1
(45) Date of Patent: May 15, 2001

(54) METHOD FOR AWARDING VARIABLE BONUS AWARDS TO GAMING MACHINES OVER A NETWORK

(75) Inventor: John F. Acres, Corvallis, OR (US)

(73) Assignee: Acres Gaming Inc., Las Vegas, NV (US)

( * ) Notice: Subject to any disclaimer, the term of this patent is extended or adjusted under 35 U.S.C. 154(b) by 0 days.

(21) Appl. No.: 09/105,981

(22) Filed: Jun. 26, 1998

(51) Int. Cl.[7] ..... A63F 9/24

(52) U.S. Cl. ..... 463/42; 463/16; 463/25; 463/30

(58) Field of Search ..... 463/16–20, 21–29, 463/30, 42, 40, 41; 273/138, 143 R

(56) References Cited

U.S. PATENT DOCUMENTS

| | | |
|---|---|---|
| 3,598,964 | 8/1971 | Dell et al. . |
| 3,796,433 | 3/1974 | Fraley et al. . |
| 3,819,186 | 6/1974 | Hinterstocker . |
| 4,072,930 | 2/1978 | Lucero et al. . |
| 4,230,265 | 10/1980 | Casaly . |
| 4,283,709 | 8/1981 | Lucero et al. . |
| 4,335,809 | 6/1982 | Wain . |
| 4,582,324 | 4/1986 | Koza et al. . |
| 4,652,998 | 3/1987 | Koza et al. . |
| 4,679,143 | 7/1987 | Hagiwara . |
| 4,775,937 | 10/1988 | Bell . |
| 4,805,907 | 2/1989 | Hagiwara . |
| 4,837,728 | 6/1989 | Barrie et al. . |
| 4,839,640 | 6/1989 | Ozer et al. . |
| 4,856,787 | 8/1989 | Itkis . |
| 4,964,638 | 10/1990 | Ishida . |
| 4,991,848 | 2/1991 | Greenwood et al. . |
| 5,042,810 | 8/1991 | Williams . |
| 5,116,055 | 5/1992 | Tracy . |
| 5,123,649 | 6/1992 | Tiberio . |
| 5,224,706 | 7/1993 | Bridgeman et al. . |
| 5,249,800 | 10/1993 | Hilgendorf et al. . |
| 5,257,179 | 10/1993 | DeMar . |
| 5,280,909 | 1/1994 | Tracy . |

(List continued on next page.)

FOREIGN PATENT DOCUMENTS

| | | |
|---|---|---|
| 589158 | 8/1986 | (AU) . |
| 649009 | 8/1991 | (AU) . |
| 647234 | 7/1992 | (AU) . |
| 655801 | 9/1992 | (AU) . |
| 633469 | 1/1993 | (AU) . |
| 70247/96 | 4/1997 | (AU) . |
| 2151054 | 7/1985 | (GB) . |
| 2211975 | 7/1989 | (GB) . |
| WO 94/12256 | 6/1994 | (WO) . |
| WO 95/22811 | 8/1995 | (WO) . |

* cited by examiner

*Primary Examiner*—Mark Sager
*Assistant Examiner*—John M Hotaling
(74) *Attorney, Agent, or Firm*—Marger Johnson & McCollom, PC

(57) ABSTRACT

A method for awarding bonuses over a gaming network having a plurality of gaming machines interconnected by a network. Play is allowed to occur on the plurality of gaming machines. A bonus period is initiating for which a bonus-triggering event (e.g. a winning combination) and an initial bonus amount is determined. The reel combinations obtained from normal play over the machines are detected and compared to the wining combination determined at the start of the bonus period. A match of the combination obtained with the winning combination initiates a bonus-triggering event that results in the bonus amount being paid out to the gaming machine which had the winning combination. In a preferred embodiment, the initial bonus amount is decremented over the bonus period so that the bonus amount won is greater if the winning combination appears at the beginning of the bonus period as opposed to near the end.

14 Claims, 4 Drawing Sheets

U.S. PATENT DOCUMENTS

| | | | | |
|---|---|---|---|---|
| 5,286,023 | | 2/1994 | Wood . | |
| 5,332,219 | | 7/1994 | Marnell, II et al. . | |
| 5,344,144 | | 9/1994 | Canon . | |
| 5,345,379 | | 9/1994 | Brous et al. . | |
| 5,370,306 | | 12/1994 | Schulze et al. . | |
| 5,401,024 | | 3/1995 | Simunek . | |
| 5,429,361 | | 7/1995 | Raven et al. . | |
| 5,470,079 | | 11/1995 | LeStrange et al. . | |
| 5,472,194 | | 12/1995 | Breeding et al. . | |
| 5,494,287 | | 2/1996 | Manz . | |
| 5,507,489 | | 4/1996 | Reibel et al. . | |
| 5,511,781 | | 4/1996 | Wood et al. . | |
| 5,536,016 | | 7/1996 | Thompson . | |
| 5,547,192 | | 8/1996 | Ishibashi . | |
| 5,551,692 | | 9/1996 | Pettit et al. . | |
| 5,580,309 | | 12/1996 | Piechowiak et al. . | |
| 5,603,659 | | 2/1997 | Okada . | |
| 5,611,730 | | 3/1997 | Weiss . | |
| 5,655,961 | | 8/1997 | Acres et al. . | |
| 5,707,286 | | 1/1998 | Carlson . | |
| 5,766,076 | * | 3/1999 | Pease et al. | 463/27 |
| 5,833,536 | | 11/1998 | Davids et al. . | |
| 5,833,538 | | 11/1998 | Weiss . | |
| 5,885,158 | * | 3/1999 | Torango et al. | 463/27 |
| 5,989,121 | * | 11/1999 | Sakamoto | 463/20 |
| 6,012,982 | * | 1/2000 | Piechowiak et al. | 463/16 |
| 6,077,162 | * | 6/2000 | Weiss | 463/26 |
| 6,110,043 | * | 8/2000 | Olsen | 463/27 |

| | | | 1ST COIN | 2ND COIN | 3RD COIN |
|---|---|---|---|---|---|
| | | | 2000 | 4000 | 10000 |
| 7 | 7 | 7 | 400 | 800 | 1200 |
| 7 | 7 | 7 | 200 | 400 | 600 |
| 7 | 7 | 7 | 150 | 300 | 450 |
| 7 | 7 | 7 | 100 | 200 | 300 |
| ANY 7 | ANY 7 | ANY 7 | 50 | 100 | 150 |
| | BAR BAR | | 50 | 100 | 150 |
| | | | 40 | 80 | 150 |
| BAR BAR | BAR BAR | BAR BAR | 25 | 50 | 75 |
| ANY RED | ANY WHITE | ANY BLUE | 20 | 40 | 60 |
| | | | 10 | 20 | 30 |
| ANY BAR | ANY BAR | ANY BAR | 5 | 10 | 15 |
| ANY | TWO | | 5 | 10 | 15 |
| ANY RED | ANY RED | ANY RED | 2 | 4 | 6 |
| ANY WHITE | ANY WHITE | ANY WHITE | 2 | 4 | 6 |
| ANY BLUE | ANY BLUE | ANY BLUE | 2 | 4 | 6 |
| ANY | ONE | | 2 | 4 | 6 |
| BLANK | BLANK | BLANK | 1 | 2 | 3 |

FIG.6

METHOD FOR AWARDING VARIABLE BONUS AWARDS TO GAMING MACHINES OVER A NETWORK

BACKGROUND OF THE INVENTION

This invention relates generally to electronic gaming machines interconnected by a computer network and more particularly to a method for varying and awarding bonuses to gaming machines over a gaming network.

Casinos typically include electronic gaming machines (EGMs) such as slot machines and video poker machines. Slot machines, for example, usually include three reels that each have a plurality of symbols printed thereon. After the player applies a wager to the machine, he or she starts play by triggering a switch that starts the reels spinning. Each reel stops at a random position and thereby presents three symbols—one from each reel. Some combinations of symbols do not pay any jackpot. Others pay varying amounts according to predetermined combinations that appear in a pay table displayed on the machine and stored in the gaming machine's programmable read-on memory (PROM).

More recently, multiple gaming machines have been linked together into groups of machines that share the same bonus pool. A simple example of such a system is progressive video poker in which players play the primary poker game on one of a plurality of gaming machines grouped together on the casino floor. A coin in counter, linked to all machines sharing the progressive pool, counts the total amount of money played in the group of machines and advances the progressive bonus pool accordingly. For instance, the casino can choose to set aside 5% of all money played on the group of video poker machines to the bonus pool. The amount of the pool is displayed on a large LED display and is incremented as money is played. This amount is awarded automatically as a bonus should a player on one of the video poker machines receive a designated winning hand such as a royal flush. After the bonus is awarded, the bonus pool is seeded with a nominal amount that is further incremented as described above.

The advantage of the progressive system is that the bonus pools from individual machines can be pooled to form larger awards which in turn attracts more players. When taken to the extreme, progressive bonuses can be pooled together not only from machines in different areas of the casino, but from different casinos in different states. More complex examples for bonusing are implemented using bonus servers over a network, such as disclosed in co-pending application Ser. No. 08/843,411, filed Apr. 15, 1997 and assigned to the Assignee of the present application (the '411 application), which is incorporated herein by reference for all purposes. Also incorporated herein by reference for all purposes is U.S. Pat. No. 5,655,961, assigned to the Assignee of the present application (the '961 patent), which also discloses bonuses that can be implemented by bonus servers over a network.

Bonusing on gaming machines also occurs for fixed amounts during all times on which the gaming machine is played. The pay table represented in FIG. 6 shows such a bonus. Referring to the top of the pay table in FIG. 6, the top jackpot award (shown as a pot on each reel) pays two thousand for a one coin bet, four thousand for a two coin bet and ten thousand for a three coin bet. The fixed bonus then, operative during all pulls of the gaming machine, yields an extra four thousand coins over and above the expected six thousand coin jackpot for a three coin bet. Such a system would not act to increase short-term gameplay since the bonus would always be active, and would either increase (as in the case of progressive jackpots) or stay fixed (as dictated by the pay table). In the case of progressive jackpots, in fact, it might hinder short term game play since the player might wait to play the game until the progressive jackpot rises over a certain amount.

Accordingly, a need remains for an bonusing system which increases play at gaming machines coupled over a network.

SUMMARY OF THE INVENTION

It is, therefore, an object of the invention to increase the rate of play on gaming machines by providing bonus awards for relatively modest reel symbol combinations for only limited periods of time.

The method is directed to awarding bonuses over a gaming network having a plurality of gaming machines interconnected by a network. Play is allowed to occur on the plurality of gaming machines. A bonus period is initiating for which a bonus triggering event (e.g. a winning combination) and an initial bonus amount is determined. The reel combinations obtained from normal play over the machines are detected and compared to the winning combination determined at the start of the bonus period. A match of the combination obtained with the winning combination initiates a bonus-triggering event which results in the bonus amount being paid out to the gaming machine which had the winning combination. In a preferred embodiment, the initial bonus amount is decremented over the bonus period so that the bonus amount won is greater if the winning combination occurs at the beginning of the bonus period as opposed to near the end.

The advantage of this concept is that it gives players the opportunity to hit large jackpots from the base progressive more frequently, by awarding more common reel combinations during specific times. It also precipitates a sense of urgency, since the smaller jackpots begin decrementing immediately, resulting in faster play.

The foregoing and other objects, features and advantages of the invention will become more readily apparent from the following detailed description of a preferred embodiment of the invention that proceeds with reference to the accompanying drawings.

BRIEF DESCRIPTION OF THE DRAWINGS

FIG. 6 is an exemplary pay table of the gaming machine of FIG. 1.

DETAILED DESCRIPTION

Figure 1:
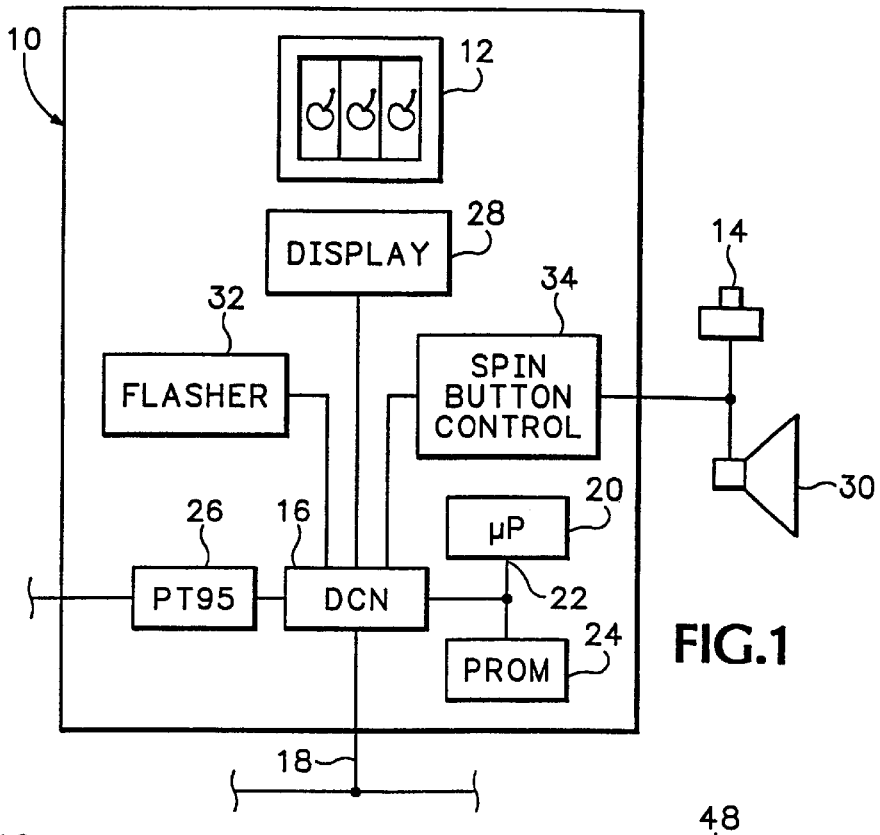
FIG. 1 is a schematic diagram of a slot machine and associated hardware implemented in accordance with the present invention.
Figure 2:
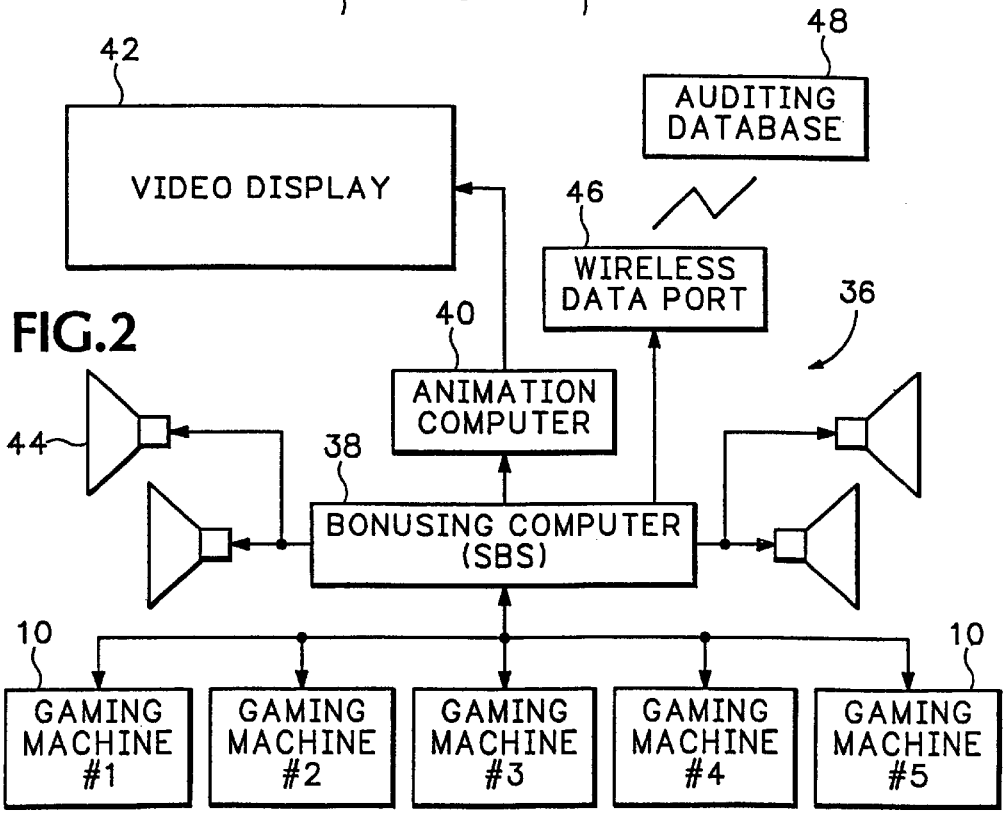
FIG. 2 is a schematic diagram of a plurality of the electronic gaming machines shown in FIG. 1 interconnected by a computer network in accordance with a preferred embodiment of the present invention.

FIG. 1 is a highly schematic representation of an electronic slot machine 10, which is typical of each of the primary electronic game machines (EGM) linked to the gaming network of FIG. 2. Each of the EGMs incorporate network communications hardware as described hereinafter. This hardware is described in the '961 patent, and is referred to therein as a data communications node (DCN). Preferably the network communications hardware is like that disclosed in the '411 application, which is referred to therein as a machine communication interface.

The EGM as shown in FIG. 1 includes a slot game that is configured to operate as described below. Included in EGM 10 are three reels, indicated generally at 12. Each reel includes a plurality of different symbols thereon. The reels spin independently in response to player input, such as by depressing button 14 after a wager is made, and stop spinning to present a randomly determined combination of symbols. Payouts in periods of normal play are made automatically in accordance with a pay table stored in memory in the slot machine 10.

FIG. 6 comprises an example of a pay table that can be applicable to EGM 10. The first three columns depict different combinations of symbols on the reels. The fourth column of FIG. 6 indicates the amount won on a single coin wager when the combination of symbols in the first three columns appears after the reels spin. Columns five and six indicate the amount won when two and three coins, respectively, are wagered. A wager of three coins on a gaming machine having the pay table shown in FIG. 6 is considered the "maximum wager" for purposes of awarding a bonus according to a preferred aspect of the invention as discussed further below. Any combination of reel symbols other than those shown in FIG. 6 does not normally result in a payment to the player. It is understood, however, that a bonus amount can be awarded according to the temporary bonusing method of the present invention for combinations which do not appear on the pay table if the combination is selected as the bonus-triggering event by means described below. Such a combination can, for instance, be an occurrence of a particular bonus initiator symbol within the reel combination that causes the triggering event.

For regulator reasons, this pay table cannot be changed in certain jurisdictions. Instead, the pay table must be fixed and any change to the pay table must be to the player's benefit so that any extra award would be payable as a bonus over and above the normal amount. As used herein, any award paid above and beyond the normal amount indicated by the pay table is referred to as a "bonus". Such would be the case of an "enhanced pay table" which is stored in memory on the gaming machine but is only active during certain bonus periods.

The network communications hardware of gaming machine 10 preferably comprises a machine communication interface or data communications node (DCN) 16 as set forth in the '411 application. DCN 16 facilitates communication between the network, via connection 18, and microprocessor 20, which controls the operation of EGM 10. This communication occurs via a serial port 22 on the microprocessor to which DCN 16 is connected. Microprocessor 20 is also connected to a memory, such as programmable read only memory (PROM) 24, which includes a preset pay table for the primary game.

Each electronic gaming machine in the network preferably includes a player tracking module 26. The player tracker module can include a card reader (not shown) that reads a player-tracking card issued by the casino to individual players who choose to have such a card. The card reader and player-tracking card are known in the art, as are player tracking systems, examples being disclosed in the '961 patent and '411 application.

Briefly summarizing such a system, a player registers with the casino prior to commencing gaming. The casino issues a unique player-tracking card to the player and opens a corresponding player account that is stored on auditing database 48 (in FIG. 2) in an accounting system. The account includes the player's name and mailing address and perhaps other information of interest to the casino in connection with marketing efforts. Prior to playing one of the EGMs in FIG. 1, the player inserts his casino-issued card into the reader thus permitting the accounting system to track player activity, such as amounts wagered and won and rate of play. This information can then be used to offer complementary items or services to the player according to the total amount wagered in order to encourage the player to continue playing at the casino. Such a player tracker system is not required for the practice of the present invention since, as shown below, bonus amounts from the bonusing system prescribed by the present invention are awarded to the machines themselves rather than the individuals playing the machines. However, it is understood that such player tracking can be included to award the bonus directly to the individual's account at the casino during cashless play.

Also included in the slot machine 10 are audio/visual outputs, such as a display 28, speaker 30 and flasher 32. The slot machine also includes an input device, such as player actuated button 14. Button 14 is configured to initiate the spinning of the reels of the slot machine game through spin control button 34. The DCN 16 facilitates communication between the network and these elements to provide an interactive experience for the player.

The player display 28 is preferably a vacuum fluorescent display (VFD) known in the art which operates to display to a player on a respective gaming machine a preestablished message responsive to the state of the gaming machine and is controlled by a bonusing computer 38 (FIG. 2). Examples of messages that can be displayed on display 28 include the name of the player (if the player tracking system is used) as well as the number of credits or coins available for play. Further messages such as "Bonus Time!" could also be displayed on each machine within display 28 to indicate that the temporary bonus period is active according to the bonusing method of the present invention.

FIG. 2 shows one embodiment of the present invention implemented in a stand-alone network 36. Such a network is capable of existing by itself on a casino floor and need not be hardwired to other types of gaming machines throughout the casino. It is understood, however, that the system described below can implemented into a networked system as described in the '961 patent and the '411 application. Preferably, however, the gaming machines should have identical reels and pay tables so that each machine in a multiple gaming machine embodiment has an equal chance of hitting a bonus combination as described below.

Similarly, it is understood that the bonusing scheme of the present invention can be implemented in a single gaming machine. In this later case, the vacuum fluorescent display 28 can show the reel combination or poker hand comprising the bonus-triggering event as well as the bonus amount available for obtaining such a combination.

The stand-alone system includes a plurality of gaming machines 10 coupled to a secondary game controller or stand-alone bonusing computer (SBS) 38 which controls the operation of the secondary and tertiary games. Included in the network 36 is a dedicated animation computer 40 which drives a large video display 42 according to animation states communicated to it via SBS 38, speakers 44 synchronized with the animation state, and a wireless data port 46 for communicating accounting data to an auditing database 48. Because of space considerations in most gaming casinos where the present bonusing scheme would be used, the video display used should take up as little depth as possible. Accordingly, it is preferred that flat panel monitors be used such as the plasma display panel manufactured by Fujitsu under their Plasmatron™ label.

The animation computer 40 can be any medium-powered computer such as one having an Intel Pentium II 266 processor, 256 MB SDRAM, a Matrox Millenium II 4 MB graphics card, CD ROM drive, 4 GB hard drive, and sound card. Gaming regulations typically require that modifiable media (e.g., hard-drive, flash BIOS, etc.) should have no impact on the outcome of the game. As the animation computer has these elements, the animation computer is configured to display a state (such as the drifting bonus balloons illustrated in FIG. 4) as defined by the bonusing computer 38. It is understood, however, that as processing speed increases and computers become more powerful, it is foreseen that responsibilities for such animation can be accomplished by the processor in the bonusing computer or other devices on the network.

The bonusing computer 38 provides the central control mechanism for the stand-alone system. Communication with the various components of the stand-alone system 36 is described below.

Play on each of the gaming machines determines the operating parameters of the machines. Exemplary parameters include: the reel combination obtained, the rate of play on the machine, the total coins played, whether a maximum bet has been made, etc. These operating parameters are collected and sent through the network to the SBS 38 via each gaming machine's data control node 16. The SBS 38 collects this data and compares them to preestablished criteria to determine whether a bonus triggering event occurs.

Figure 3:
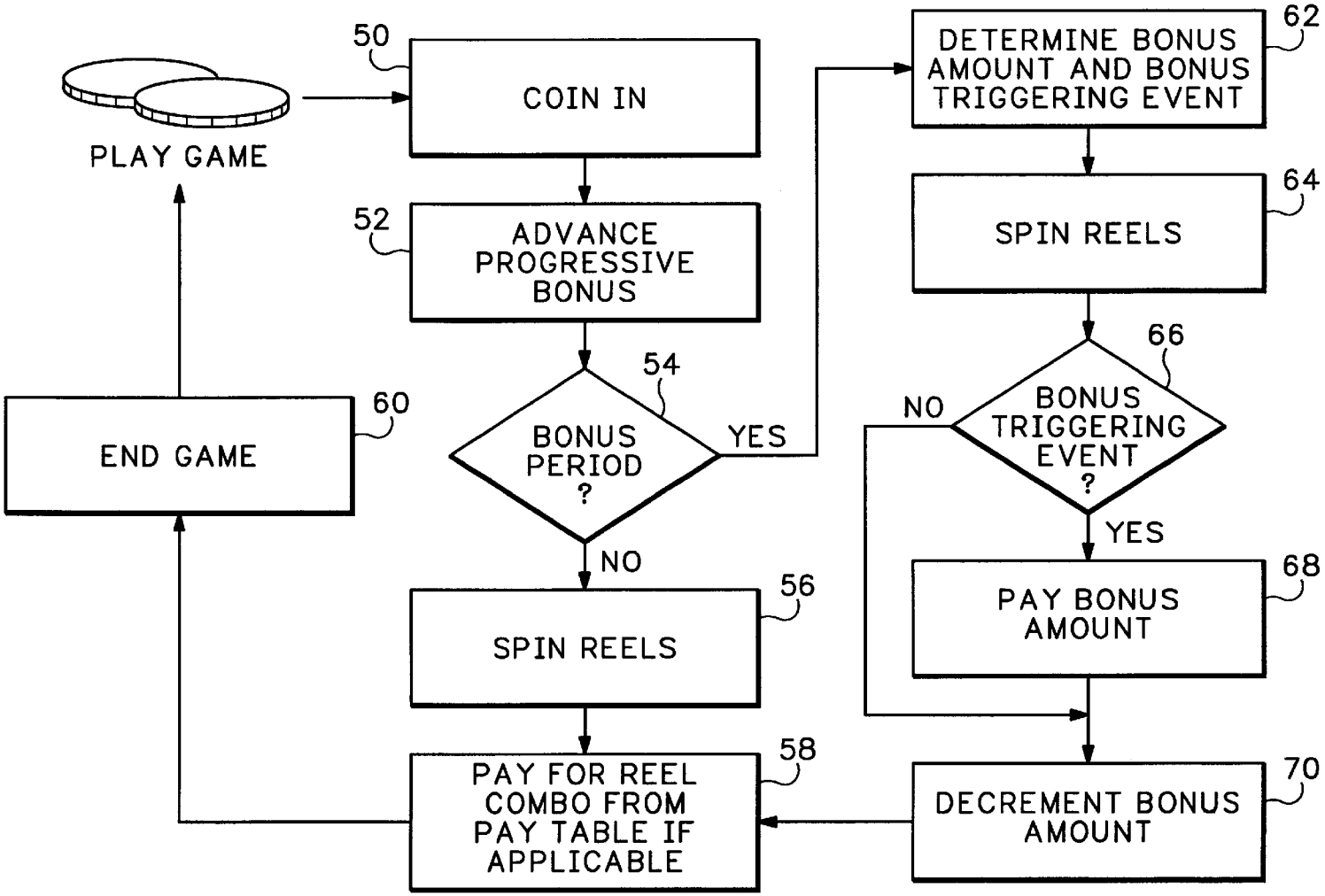
FIG. 3 is a flow chart that depicts the operation of the FIG. 2 network in accordance with the present invention.

FIG. 3 is a flow diagram showing the steps for bonusing the gaming machines of FIGS. 1 and 2 according to a preferred embodiment of the invention. A player starts play by inserting coins in one of the gaming machines 10 (step 50). The number of coins played is communicated through the gaming machine's DCN 16. The progressive meter is then advanced (step 52) according by a user configurable percentage of the amount played. If no bonus period is active (step 54), the player operates the gaming machine normally by activating button 14 which spins the reels (step 56) to thereby present a randomly determined combination of symbols. The combination obtained is compared to the pay table—such as the one shown in FIG. 6 and stored in PROM 24—and the player is awarded money or credits (step 58) as applicable. The game then ends (step 60) and the player can choose to cash out, insert more coins, or play from credits stored at the gaming machine.

If a bonus period is active, the bonusing computer 38, coupling the gaming machines 10 together over the network, determines a bonus amount and bonus triggering event in step 62. This step occurs only once during any one bonus period. Thereafter, the winning combination is maintained and the bonus amount is adjusted as described below with reference to FIG. 4.

The bonus amount and bonus-triggering event (i.e., the winning reel combination for the bonus amount) are preferably decided in a two step decision. The first decision is to select the Pay Line that is required to win the bonus from one of the pay lines listed in the pay table of FIG. 6. In its most preferred embodiment, the pay line chosen is one of the more common combinations (such as BAR—BAR—BAR) to make it more likely that one would win the temporary bonus and add more excitement for the players. The second decision is to select the initial bonus amount associated with that Pay Line. The initial bonus amount can be determined by any method without limiting the practice of the bonusing method of the present invention. For instance, the initial bonus amount could be a randomly selected number, a multiplier bonus above and beyond the pay table award, a percentage of the progressive jackpot, or any combination therebetween.

After the initial bonus amount and bonus-triggering events are determined in step 62, the player operates the gaming machine normally by pressing the spin button 14 (FIG. 1). In slot machines, the reels spin (step 64) responsive to the pressing of the spin button and a combination of symbols from the machine reels is presented. The reel combination obtained is transmitted to the bonusing computer 38 (FIG. 2) which is then compared in step 66 to the winning bonus combination determined in an earlier process. If, during the bonus period, the reel combination matches the wining bonus combination, then a bonus-triggering event occurs whereupon the bonus amount is paid in step 68 to the credit meter of the gaming machine that obtained the combination. The display 28 (FIG. 1) of the particular gaming machine can display a message indicating that the player has won the bonus. Whether or not any bonus is paid, the combination obtained is compared to the pay table in the normal fashion (step 58) to determine whether a regular award is applicable.

The length of the bonus period, within which the bonus amount can be won by obtaining the particular winning bonus combination, is a predetermined length of time subject to the following caveat: if the winning combination is obtained during any portion of the bonus period, then the bonus amount is paid out and the bonus period ends. In a preferred aspect of the bonusing scheme, the initial bonus award is adjusted during the bonus period to alter its value. Most preferably, the initial bonus amount is continuously decremented as shown in step 70 of FIG. 3.

Figure 4:
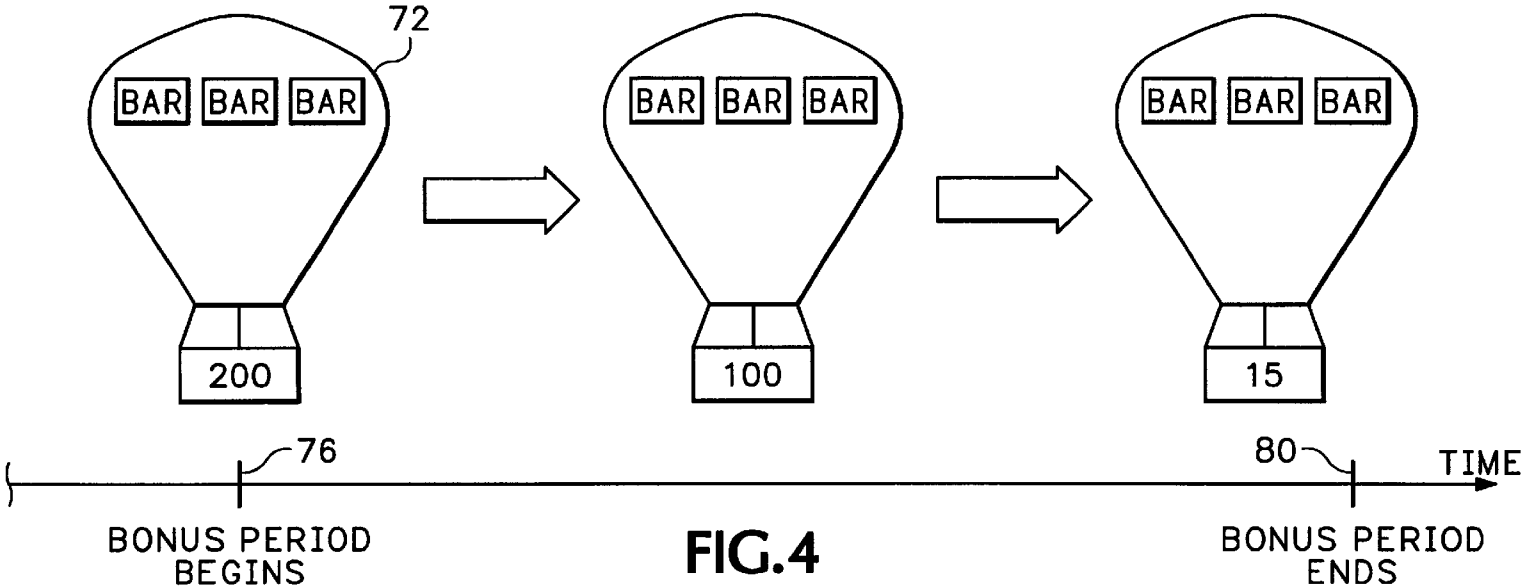
FIG. 4 is a time line illustrating the decrementing value of an exemplary temporary jackpot active within a bonus period according to a preferred embodiment of the invention.

FIG. 4 illustrates a time line over which the bonus is decremented. The bonus period runs for an amount of time determined at the beginning of the bonus period. The time can be either some randomly generated time period, a time period stored in some lookup table stored on the bonusing computer, or after a certain number of games. Though it is preferred that the bonus period ends after a bonus triggering event occurs, it is possible to continue the bonus period until the originally determined time period expires.

FIG. 4 shows the winning reel combination for the bonus-triggering event to be BAR—BAR—BAR which is a relatively common jackpot combination compared to some of the other jackpot awards listed in the FIG. 6 pay table. The wining combination is shown illustrated in an animated balloon 72 that shows the initial bonus amount as two hundred. As the bonus period runs, the bonus amount is decremented so that it is at one hundred at the midway point and at fifteen near the expiration of the bonus period. For instance, if the bonus period is slated to run for 100 seconds, then the initial bonus can be reduced by two dollars per second until the bonus period ends.

The animated balloon is a preferred theme for conveying the transitory nature of the award. For instance, when a bonus amount and winning combination for the bonus is determined, the animation computer 40 (FIG. 2) can be instructed by the bonusing computer 38 to generate the image of a balloon on the video display 42 with the combination for and amount of the award prominently displayed within the balloon. Another parameter, the length of the bonus period, can be used by the bonusing computer to calculate the speed at which the bonus amount is decremented and/or the speed at which the balloon drifts across the width of the video display 42. The bonus period then ends when: the bonus is won by obtaining a winning combination, when the bonus amount goes to zero, or when the balloon disappears off the side of the video display.

Figure 5:
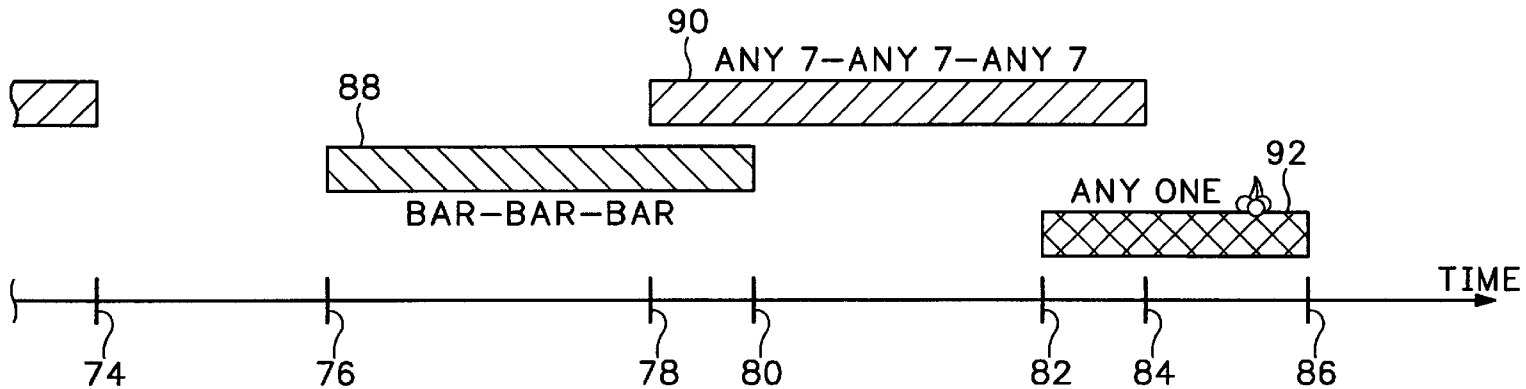
FIG. 5 is a exemplary time line illustrating multiple temporary jackpots active over differing periods of play on the gaming machine network of FIG. 2.

FIG. 5 shows a time-line over which multiple bonus periods can be active according to an alternate embodiment of the bonusing scheme of the present invention. The points along the time-line are: the end of the first bonus period 74, the start of the second bonus period 76, the start of the third bonus period 78, the end of the second bonus period 80, the start of the fourth bonus period 82, the end of the third bonus period 84 and the end of the fourth bonus period 86. Bar 88 shows the length of time over which the second bonus period is active, absent a bonus triggering event (BAR—BAR—BAR). Bar 90 shows the length of time over which the third bonus period (where ANY 7—ANY 7—ANY 7 is the winning combination) is active. Finally, bar 92 shows the length of time over which the fourth bonus period is active (where ANY ONE CHERRY is the winning combination). As can be seen from the time-line, there is no bonus period between time 74 and time 76 and after time 86 but there are two concurrently running bonus periods between time 78 and 80 and between time 82 and 84.

In the progressive concept of the present invention, a base progressive for a machine's top award is used to float smaller jackpots to players who hit certain combinations at the predetermined time. When the smaller jackpot "jumps" on the screen for a more common reel combination (e.g. Bar—Bar—Bar) the amount (funded by the base progressive) decrements until it is hit, or it is gone. The advantage of this concept is that it gives players the opportunity to hit large jackpots from the base progressive more frequently, by awarding more common reel combinations during specific times. It also precipitates a sense of urgency, since the smaller jackpots begin decrementing immediately, resulting in faster play.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A method for awarding bonuses over a gaming network having a plurality of gaming machines interconnected by a network, the method comprising the steps of:

allowing play to occur on a plurality of gaming machines;

initiating a bonus period;

determining a bonus-triggering event;

determining an initial bonus amount;

decrementing the initial bonus amount over the bonus period to yield an adjusted bonus amount; and paying out the adjusted bonus amount responsive to the bonus-triggering event.

2. The method of claim 1 further including:

setting aside a predetermined percentage of amounts wagered on each of the gaming machines into a progressive jackpot; and apportioning a randomly determined portion of the progressive jackpot to the initial bonus amount.

3. The method of claim 1 further including the step of randomly establishing a triggering event from one of a plurality of triggering events concurrent with the step of initiating a bonus period.

4. The method of claim 1, wherein the bonus period is initiated responsive to a predetermined number of plays on the plurality of gaming machines.

5. The method of claim 2, wherein the bonus period is initiated when the progressive jackpot reaches a certain level.

6. The method of claim 1, wherein the bonus period is for a predetermined amount of time.

7. The method of claim 1, wherein the bonus period is for a predetermined amount of plays on the gaming machines.

8. The method of claim 1, further including the steps of:

determining an amount wagered for each play on the gaming machines; and awarding the adjusted bonus amount only if the amount wagered on a gaming machine just prior to the triggering event was at least a minimum amount.

9. The method of claim 1 wherein the bonus-triggering event is a selected reel combination on a slot machine.

10. The method of claim 1, wherein the bonus-triggering event is a selected reel combination on a slot machine, the method further including:

displaying the selected reel combination during the bonus period; and displaying the adjusted amount.

11. The method of claim 9, further including:

displaying the selected reel combination within a balloon rendered on a video monitor, moving the balloon and displayed reel combination across a video monitor; and ending the bonus period when the balloon and displayed reel combination moves off the video monitor.

12. The method of claim 1 wherein the bonus-triggering event is a selected initiator symbol on a slot machine.

13. A method for enabling play on a gaming machine comprising the steps of:

allowing play to occur on the gaming machine, said gaming machine having a pay table associated therewith;

awarding to a user of the gaming machine a normal award responsive to the pay table;

initiating a bonus period;

determining an initial bonus amount and a bonus-triggering event;

decrementing the initial bonus amount over time to yield an adjusted bonus amount;

detecting a bonus-triggering event over the bonus period; and awarding to a user of the gaming machine the adjusted bonus amount over and above the normal award responsive to the detected bonus-triggering event.

14. The method of claim 13, further including the step of ending the bonus period after detecting a bonus-triggering event.

* * * * *